US010918141B2

(12) United States Patent
Nordstrom et al.

(10) Patent No.: US 10,918,141 B2
(45) Date of Patent: Feb. 16, 2021

(54) DRAG-REDUCING EXERCISE EQUIPMENT

(71) Applicant: NIKE, Inc., Beaverton, OR (US)

(72) Inventors: Matthew D. Nordstrom, Portland, OR (US); Jorge E. Carbo, Jr., Aloha, OR (US); Leonard W. Brownlie, West Vancouver (CA)

(73) Assignee: NIKE, INC., Beaverton, OR (US)

( * ) Notice: Subject to any disclaimer, the term of this patent is extended or adjusted under 35 U.S.C. 154(b) by 127 days.

(21) Appl. No.: 15/866,988

(22) Filed: Jan. 10, 2018

(65) Prior Publication Data

US 2018/0192711 A1 Jul. 12, 2018

Related U.S. Application Data

(63) Continuation-in-part of application No. 13/380,289, filed as application No. PCT/US2010/039840 on Jun. 24, 2010, now abandoned.

(60) Provisional application No. 61/220,184, filed on Jun. 24, 2009.

(51) Int. Cl.

| | |
|---|---|
| ***A41D 13/00*** | (2006.01) |
| ***A41H 43/04*** | (2006.01) |
| ***A41D 31/18*** | (2019.01) |

(52) U.S. Cl.

CPC ..... *A41D 13/0015* (2013.01); *A41D 31/185* (2019.02); *A41H 43/04* (2013.01); *A41D 2400/24* (2013.01); *A41D 2600/10* (2013.01)

(58) Field of Classification Search

CPC ..... A41D 13/0015; A41D 2400/24; A41D 2600/10; A41H 43/04

USPC ..... 2/69

See application file for complete search history.

(56) References Cited

U.S. PATENT DOCUMENTS

| | | | |
|---|---|---|---|
| 3,881,041 | A | 4/1975 | Glienke |
| 4,180,606 | A | 12/1979 | Hance et al. |
| 4,438,533 | A | 3/1984 | Hefele |
| 4,972,522 | A | 11/1990 | Rautenberg |
| 5,033,116 | A | 7/1991 | Itagaki et al. |
| 5,887,280 | A | 3/1999 | Waring |
| 6,029,282 | A | 2/2000 | Buschman |
| 6,044,494 | A | 4/2000 | Kang |

(Continued)

FOREIGN PATENT DOCUMENTS

| | | | |
|---|---|---|---|
| GB | 443635 | A | 2/1936 |
| JP | H0233305 | A | 2/1990 |

(Continued)

OTHER PUBLICATIONS

Brownlie, Leonard W., "Aerodynamic Characteristics of Sports Apparel", Nov. 1992, Simon Fraser University, 150 pages.

(Continued)

*Primary Examiner* — Anne M Kozak

(74) *Attorney, Agent, or Firm* — Shook, Hardy & Bacon L.L.P.

(57) ABSTRACT

Drag-reducing exercise equipment in the form of a aerodynamic garment may comprise zones with applied textures. Each zone may be associated with properties and characteristics based on the movement of the garment associated with each zone through air during an athletic activity. The texture in each zone may be applied using a variety of methods such as printing. The resulting aerodynamic garment improves the performance of an athlete wearing the aerodynamic garment by reducing the aerodynamic drag experienced during the performance of the athletic activity.

18 Claims, 15 Drawing Sheets

(56) References Cited

U.S. PATENT DOCUMENTS

| | | | |
|---|---|---|---|
| 6,279,161 | B1 | 8/2001 | Johnston |
| 6,438,755 | B1 | 8/2002 | MacDonald et al. |
| 6,446,264 | B2 | 9/2002 | Fairhurst et al. |
| 6,622,312 | B2 | 9/2003 | Rabinowicz |
| 6,673,421 | B1 | 1/2004 | Andrews et al. |
| 6,977,023 | B2 | 12/2005 | Abrams |
| 7,228,809 | B2 | 6/2007 | Angelino et al. |
| 7,378,043 | B2 | 5/2008 | Hassan et al. |
| 7,636,950 | B2 | 12/2009 | Melhart et al. |
| 2005/0268407 | A1 | 12/2005 | Abrams |
| 2006/0070165 | A1 | 4/2006 | Nordt et al. |
| 2006/0080755 | A1 | 4/2006 | Baron et al. |
| 2006/0185053 | A1 | 8/2006 | Wittmann et al. |
| 2006/0200890 | A1 | 9/2006 | Prat Gonzalez |
| 2007/0022510 | A1 | 2/2007 | Chapuis et al. |
| 2007/0033696 | A1 | 2/2007 | Sellier |
| 2008/0189825 | A1 | 8/2008 | Wright et al. |
| 2009/0139010 | A1 | 6/2009 | Bevier |
| 2010/0081984 | A1 | 4/2010 | Coffinardi et al. |

FOREIGN PATENT DOCUMENTS

| | | | |
|---|---|---|---|
| JP | H03137204 | A | 6/1991 |
| JP | 2001270019 | A | 1/2001 |
| JP | 3081435 | U | 11/2001 |
| JP | 2003105608 | A | 4/2003 |
| JP | 2006037311 | A | 2/2006 |

OTHER PUBLICATIONS

NPL Adjacent, adj. Merriam-Webster.com. Jul. 2015. Web. Jul. 13, 2015, http://www.merriam-webster.com/dictionary/adjacent.

Search Report dated Mar. 6, 2018 in European Patent Application No. 18151098.3, 8 pages.

Office Action received for European Patent Application No. 18151098.3, dated Apr. 30, 2020, 5 pages.

Non-Final Office Action dated Jan. 2, 2019 in U.S. Appl. No. 13/399,742, 30 pages.

100

DRAG-REDUCING EXERCISE EQUIPMENT

CROSS-REFERENCE TO RELATED APPLICATIONS

This Application, entitled "Drag-Reducing Exercise Equipment," is a Continuation-in-part application which claims priority to U.S. application Ser. No. 13/380,289, filed Feb. 16, 2012, and entitled "Aerodynamic Garment with Applied Surface Roughness and Method of Manufacture," which claims priority to PCT Application No. PCT/US2010/039840, filed Jun. 24, 2010, and entitled "Aerodynamic Garment with Applied Surface Roughness and Method of Manufacture," which claims priority to U.S. Provisional Patent Application No. 61/220,184, filed Jun. 24, 2009, and entitled "Aerodynamic Garment with Applied Surface Roughness and Method of Manufacture." The entireties of the aforementioned applications are incorporated by reference herein.

FIELD

The present disclosure relates to drag reducing exercise equipment such as an aerodynamic garment, for improving athletic performance, and its method of manufacture. More particularly, the aerodynamic garment has surface roughness applied to the garment at key locations so as to more effectively optimize the air flow around an athlete wearing it, and thereby reduce the drag on the athlete.

BACKGROUND

Aerodynamic garments, such as tight fitting shirts, pants, and full body suits, are gaining in popularity as a means to improve athletic performance. In general, these garments improve athletic performance by reducing the aerodynamic drag acting on the athlete wearing it. Drag is produced when a fluid, such as air, flows around an object, forming eddies. Previous attempts to address the issue of drag have focused on the selection of materials used to form an athletic garment so as to minimize the drag on an athlete wearing the garment while engaging in an athletic activity. These garments have generally worked to reduce drag in two ways. First, garments have been designed to be tight-fitting and to present a smooth, unwrinkled fabric surface toward the wind-facing portions of the athlete's body. Second, garments have been made of a particular fabric(s) that offers a particular surface texture known for optimally engaging the wind at the usual speeds in which the athlete will be moving while wearing the garment. In both of these methods, the drag on a garment is based on the selection of the fabric utilized to create the garment.

Efforts by engineers and designers to quantify and select the optimal surface texture of an aerodynamic garment for a particular sporting event have had limited success. For example, in his published Ph.D. thesis titled "Aerodynamic Characteristics of Sports Apparel" (Author: Leonard W. Brownlie, Simon Fraser University, Apr. 14, 1993, School of Kinesiology, the disclosure of which is hereby incorporated by reference), Ph.D. candidate Leonard W. Brownlie documents tests that he performed to determine the drag reducing effects of various stretch fabrics, each with a different surface texture, when draped over a cylinder in a wind tunnel.

Mr. Brownlie concludes that "the surface roughness property of some stretch fabrics allows utilization of these fabrics to reduce [drag forces] on the human form in a variety of athletic endeavors." (Abstract, page iii). However, his tests were limited to fabrics from commercial, off-the-shelf athletic garments without giving much guidance for determining how to select the optimal surface textures for a particular athletic event.

More recently, inventors have attempted to quantify a system for selecting fabrics having surface roughness for providing optimal aerodynamic drag reduction during a particular sporting event. For example, in U.S. Pat. No. 6,438,755 to MacDonald et al., the disclosure of which is hereby incorporated by reference, the inventors teach determining and optimizing the Reynolds number of sections of an athletes body based on the size of that section and the speed of the air traveling over that section during the desired athletic activity. Based on the calculated Reynolds number for each section, different fabrics having different surface roughnesses are then selected for each body section. The result is an athletic garment produced with different fabrics joined together, which each different fabric positioned at its optimal location on the suit so as to optimize overall athletic performance of an athlete wearing it.

While MacDonald et al. offers a significant advancement in aerodynamic garment designs, it also requires a plurality of different fabrics to be secured together, which increases production costs and, depending of the fabrics selected, may decrease wearer comfort and the like. Further, methods of generating aerodynamic garments under MacDonald et al. are based on the selection of fabrics based primarily on their characteristic drag coefficients, independent of whether the chosen fabric(s) possessed other desirable characteristics, such as stretching properties, flexibility, breathability, etc. Accordingly, while garments produced under MacDonald et al. may be aerodynamically favorable, the resulting garments likely will not be optimized for comfort, thermodynamics, perspiration management, weight, and other comfort and/or performance characteristics across the garment.

SUMMARY

Accordingly, despite the improvements of known athletic garments, there remains a need for cost-effective athletic garments that more effectively allow the aerodynamic drag-reducing effects of selective surface roughnesses to be optimized while taking into account the additional properties of the fabrics worn by athletes. There is also provided a related efficient and economical method of making this garment. By choosing a base fabric that is optimized for comfort and/or non-aerodynamic performance factors, textured surfaces may be selectively applied to the basic fabric to gain desired aerodynamic properties to optimize the overall effectiveness of the aerodynamic garment in aiding an athlete's top performance while wearing the aerodynamic garment. As disclosed more fully in the specification of this application, the present invention fulfills these and other needs.

An athletic garment in accordance with the present invention may be composed of one type of fabric, or even a single piece of fabric, and sections having different surface roughness may be formed by applying textures applied to areas on the garment. As a result, the fabric of a sporting garment may be selected for functional, or even esthetic, reasons other than surface roughness. For example, a fabric with advantageous moisture management characteristics but disadvantageous aerodynamic properties may be used for a garment, with a texture applied to the fabric to produce advantageous aerodynamic property or properties. Accordingly, a garment in accordance with the present invention may possess advantageous aerodynamic properties while also possessing other desirable functional and/or esthetic properties not otherwise attainable.

The surface roughness and/or surface roughnesses may be applied with one or more conventional transfer techniques such as inkjet or other printing, silk screening, heat transfer, over-molding and/or the like. The surface roughness may be selected to provide the most appropriate texture at each body location for the air velocity likely to be experienced at that body location for the given athletic event. If a garment in accordance with the present invention is constructed of multiple pieces of fabric, either of the same or different types, the application of surface roughness to fabrics at the seams joining the fabric pieces allows for the minimization of air resistance at the seams. For example, a texture may be placed on top of seams and/or areas surrounding seams to reduce, the impact of seams on an air profile. Further, silicone or other material may be used to form hems and/or treat edges of fabric, such as may be encountered at hems near wrists, ankles, and/or necks. The use of silicone or other material at such a hem may add elasticity while reducing the weight and/or bulk of other types of hem, while also preventing fraying of the fabric. Yet a further option of using silicone or other material for a hem of a garment in accordance with the present invention is that flocking may be applied to all or part of the hem to reduce aerodynamic drag at the hem.

A garment in accordance with the present invention may comprise a unitary body suit. A unitary body suit may be constructed from a single type of fabric or multiple types of fabric. Any seams used to construct such a unitary body suit may be positioned to minimize drag during one or more athletic activity. A unitary body suit in accordance with the present invention may be donned through an opening positioned anywhere in the garment. An opening through which a unitary body suit is donned may optionally be closed using any type of fastener, such as zipper(s), a hook and loop system, buttons, snaps, etc. If a closure mechanism is used, a surface roughness may be applied to the garment as described herein to minimize the aerodynamic drag of the closure mechanism. One example of a unitary body suit in accordance with the present invention may provide an opening for the neck and optionally a portion of the back of an athlete while being constructed of a fabric with sufficient elasticity to permit the athlete to don the garment through that opening. In such an example, the aerodynamic drag associated with the opening may be reduced for forward facing movement by eliminating the need for a closure mechanism. The closure mechanism may be avoided by using the elasticity of the fabric to maintain an acceptable fit, and ventilation may be provided to the athlete for cooling and comfort during exertion.

The application of a texture on a garment influences the drag properties of the garment when it is worn by an athlete during an athletic activity. As stated above, drag is produced when a fluid, such as air, flows around an object. The air flowing around the object separates at a location on the object, forming eddies. The location on an object at which the air flow breaks into eddies depends upon the shape of the object and the speed at which the air moves relative to the object. For instance, air flowing around a slow-moving cylinder may produce relatively small eddies. However, air flowing around a fast-moving cylinder of the same size as the slow-moving cylinder may produce relatively large eddies.

One way to lessen the drag of an object, such as a fast-moving cylinder, is to promote tripping of the air flowing around the object. Tripping of an air flow involves changing the texture on the outside of an object to induce laminar flow. For instance, air flowing around a smooth cylinder may be tripped by adding a texture to the surface of the cylinder. The texture may hold the air near the surface of the cylinder, allowing air to flow around a larger area(s) of a cylinder than if the cylinder lacked the added texture. By increasing the amount of time the air flows in a laminar flow around a cylinder, the intensity of eddies may be smaller when the air flow around the cylinder breaks. In this way, the application of textures to the surface area of an object may influence the amount of drag produced by air flowing around the object. The object may be an aerodynamic garment being worn by an athlete. As different parts of an athlete's body move at different speeds during an activity, different textures may need to be applied across the aerodynamic garment to account for such variances. As such, by selectively applying textures to areas of an aerodynamic garment, the drag on the garment may be controlled. Additionally, the application of different textures may be used to control the drag on items other than athletic clothing. For instance, drag resulting from air flow around a ball, sports equipment, a vehicle, a structure, etc. may be reduced through the use of applied textures.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
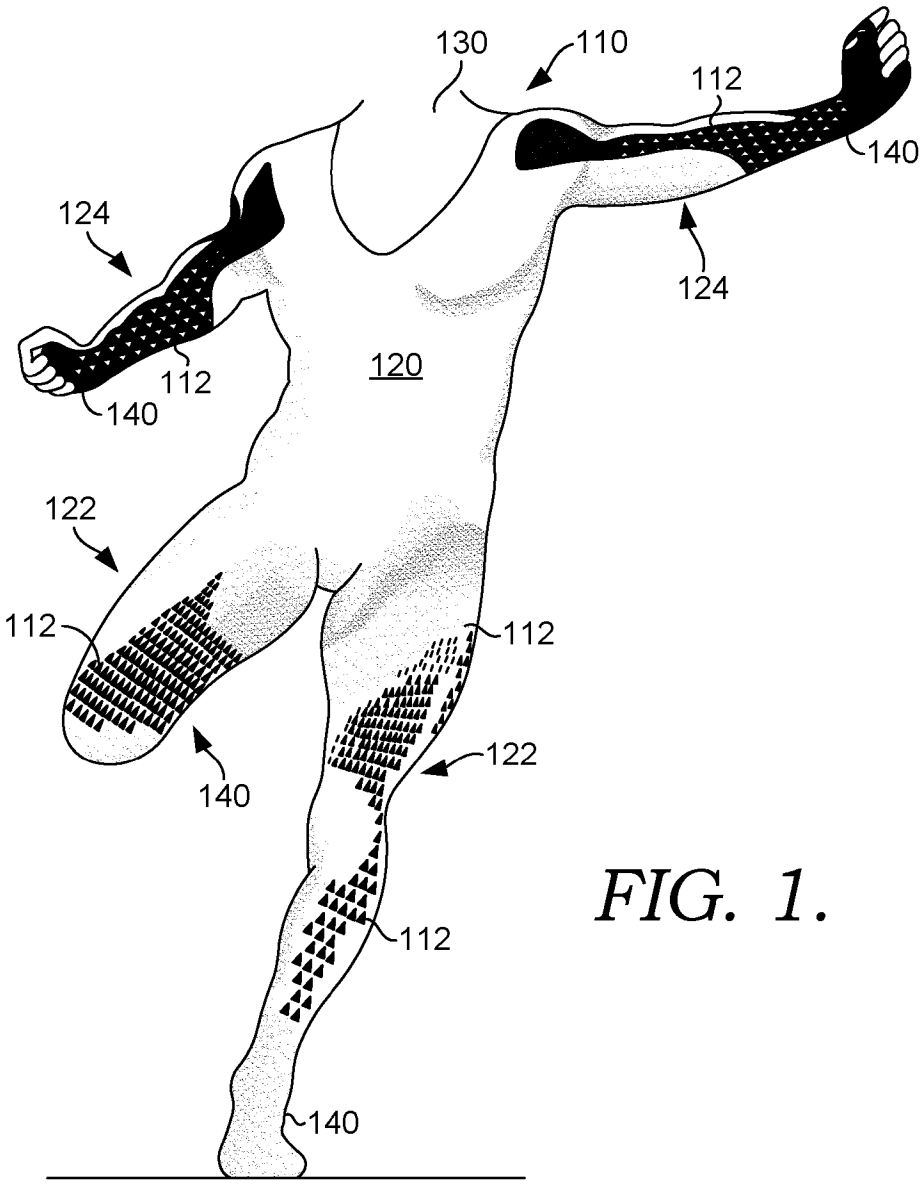
FIG. 1 illustrates a front view of an example athletic garment in accordance with the present invention.
Figures 2, 3, 4, 5, 6:
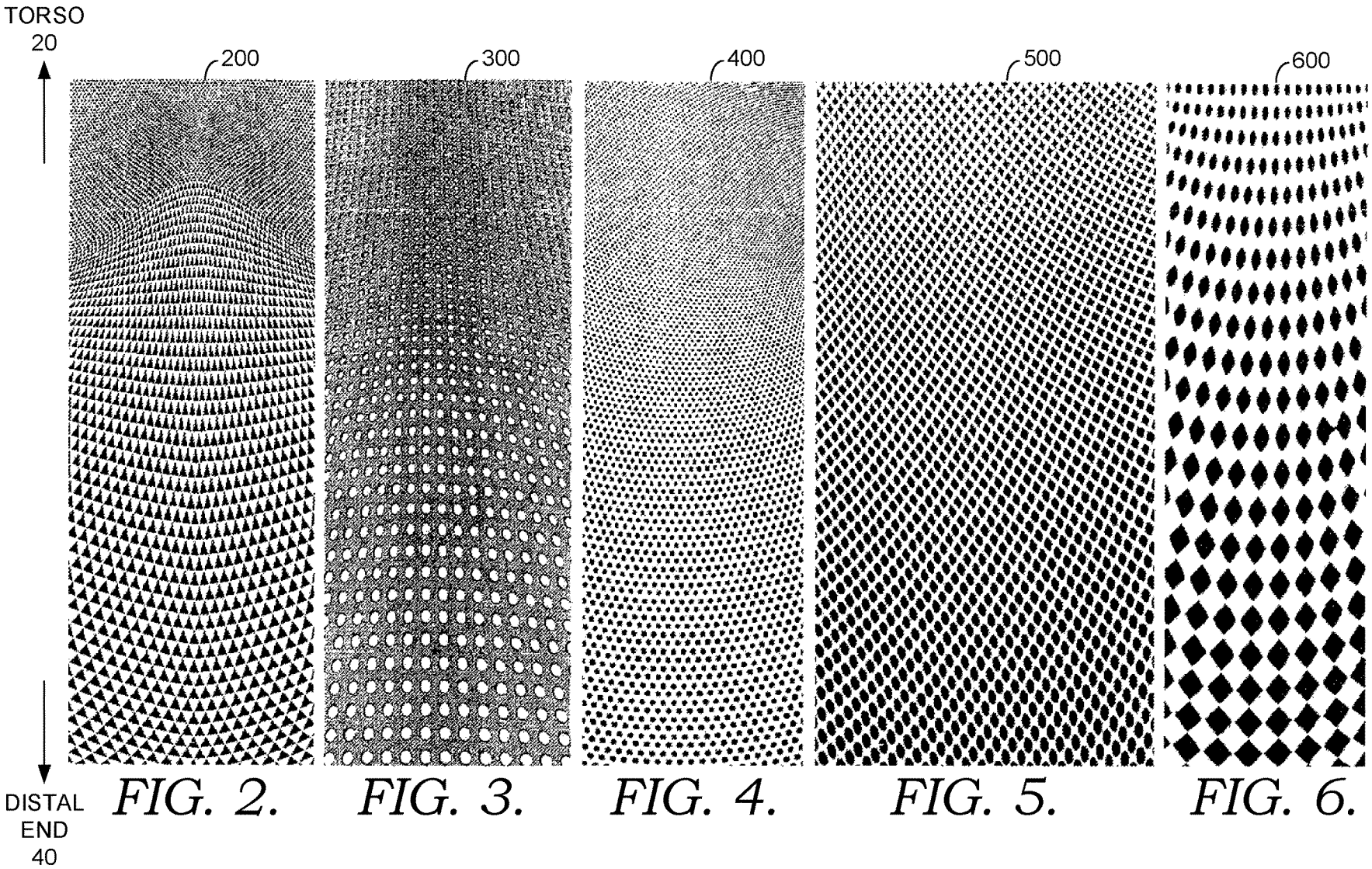
FIGS. 2-6 illustrate a plurality of example texture patterns that may be used on selected regions of an athletic garment in accordance with the present invention.

Referring to FIG. 1, an exemplary embodiment 100 of an athletic garment 110 with sections of surface roughness 112 applied thereto is shown. Athletic garment 110 is a suit having a torso portion 120, leg portions 122 and arm portions 124. Each portion may be sized and shaped to snugly cover their respective portions of an athlete 130 as shown. Each of the portions 120, 122, 124 may be formed of with a fabric offering optimal stretching, comfort, and/or performance effects for the region of the body over which it covers. Sections of surface roughness 112 may be applied to the underlying fabric of the suit to further optimize aerodynamic properties of the suit, such as the drag reducing properties of the suit. As such, the respective portions 120, 122, 124 of the garment 110 may be formed from a sheet of material that is not necessarily selected for its optimal aerodynamic properties. Rather, those properties may be optimized by the application of the surface roughness 112 at optimal locations along the garment 110. For example, texture may be applied to a garment in order to trip air flow so as to reduce drag on the garment. The application of surface roughness 112 may be applied to an athletic garment, such as garment 110, to optimize aerodynamic properties of the garment, independent of the aerodynamic properties of the garment. As such, surface roughness 112 may also and/or alternatively be applied to a garment with near-optimal aerodynamic properties as well as a garment with poor aerodynamic properties.

Referring to FIGS. 2-6, a plurality of exemplary texture patterns 200-600 are depicted having both a torso end 20 and a distal end 40 for use on selected regions of an athletic garment in accordance with embodiments of the present invention. By applying the patterns to the fabric, rather than relying purely on the surface roughness of a particular fabric used in the underlying suit, the size, density, arrangement, flocking, and/or shape of the surface roughness may be optimized. For example, the aerodynamic benefits of increased surface roughness may increase at higher air speeds. Accordingly, the surface roughness (i.e. textured pattern's size, density, arrangement, flocking and/or shape) may be greatest towards the distal ends 140 of the leg portion 122 and arm portions 124, which move the fastest during many athletic events. Further, each area of an aerodynamic garment that is exposed to an air profile may be enhanced with a texture that is applied to the garment. In these instances, the texture applied to each area of an aerodynamic garment may be optimized to perform in conditions that are most likely to occur in the performance of an athletic event. For instance, an aerodynamic garment designed for a sprinter may be enhanced to optimize performance of short events such as a 100-meter dash, 400-meter race, etc. Alternatively, an aerodynamic garment may be designed for a marathon runner that is enhanced with textures that are optimal for running conditions of approximately five minutes per mile. Further, garments may be designed with applied textures to optimize the performance of running hobbyists who have running times of ten minutes per mile, eight minutes per mile, etc. The placement and textures used to design a garment to be used in running a 100-meter dash may be quite different than those used to design a marathon runner's garment.

Moreover, surface roughness patterns may smoothly transition between portions of the garment. For example, as shown in FIG. 1, the torso portion 120 may have little or no added surface roughness, and the surface roughness on the arm and leg portions 124, 122, respectively, of the garment smoothly transition from little or none adjacent to the torso to gradually increasing surface roughness towards the respective distal ends of the arm and leg portions.

The surface roughness 112 may be applied toward the windward facing leading edges of the aerodynamic garment associated with the wearer's body, which are also often called the "wet edges." An athletic activity performed by an athlete wearing the garment may have wet edges that are based on a plurality of positions of the athlete during the athletic activity. Pluralities of positions of the athlete during the athletic activity are further discussed in FIG. 7. The applied surface roughness 112 may extend entirely around all fast-moving portions of the athlete whose wet edges tend to move during the athletic activity such as around the forearm and calves of a runner. Further, the applied surface roughness 112 may be attached to any portion of the athletic garment that is impacted by an air profile associated with an athletic activity.

Zones of an athletic garment may be defined based on body positions of an athlete engaged in an athletic activity. Additionally and/or alternatively, zones on an athletic garment may be based on size, proportion, and/or body composition of an athlete wearing the athletic garment during an athletic activity. Further, the type and pattern of a texture applied to each zone of an athletic garment may be based on different, shapes, sizes, and/or body compositions of an athlete.

An athletic garment worn by a wearer during an athletic activity may have a first zone and a second zone. The first zone may have a first applied texture having a first property that gives rise to a first aerodynamic characteristic. Further, the first zone may cover a portion(s) of an extremity of the wearer. The second zone may have a second applied texture having a second property that gives rise to a second aerodynamic characteristic. The second zone may substantially cover the torso of the wearer. Further, an intermediate zone may extend between the first zone and the second zone. The intermediate zone may have a texture that gradually varies from the first applied texture to the second applied texture.

Texture may be applied to a garment by identifying a zone of a garment based on the air flow resulting from the body position and movement relative to ambient air of an athlete wearing the garment during an athletic activity. An identified zone may correspond 30 to at least one extremity of the wearer. A texture having a property to decrease drag generated from air flow around the at least one extremity may be determined. One example of an applied texture is smooth, thin silicone discs that are applied to a portion of a garment. Silicone discs or other shapes may be applied by printing silicone on a garment and/or fabric for forming into a garment. Any printing process may be used to apply silicone to the surface of a garment. Another example of an applied texture is flocked nodules. Flocked nodules may be formed by applying liquid adhesive to a garment, such as liquid silicone as discussed above, and then applying fibers to the liquid adhesive. The liquid adhesive may be applied across at least a portion of the garment. After the adhesive has dried or sufficiently bonded to the fibers, excess fibers that did not contact the adhesive may be removed by shaking, blowing, etc. The fibers of the nodule may be oriented in any number of ways, including uniform orientation and randomized orientation. For example, nylon fibers may be aligned electrostatically to produce a uniform orientation of the fibers in a flocked nodule. Both flocked and unflocked nodules may be shaped in various ways, such as circles, squares, ovals, diamonds, various polygons, etc. Various shapes may be used on the same garment and/or portion of a garment. Further, both flocked and unflocked nodules may be used on the same garment and/or portion of a garment.

Figure 7:
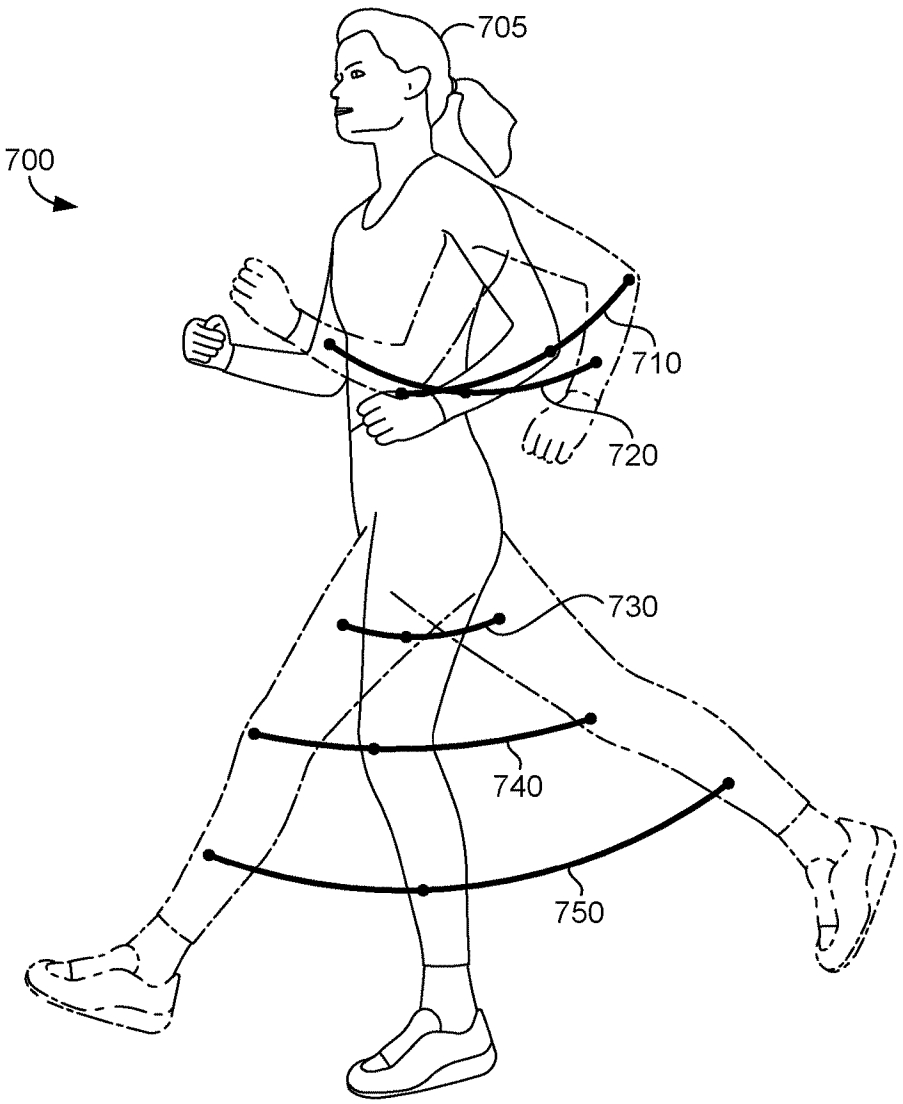
FIG. 7 illustrates an example of a plurality of positions an athlete may take relative to ambient air during an athletic activity in accordance with the present invention.

FIG. 7 illustrates ranges 700 of positions of an athlete engaging in an athletic activity while wearing a garment in accordance with the present invention. In particular, FIG. 7 illustrates ranges 700 of the movement of an athlete's left arm and left leg during running. A garment in accordance with the present invention may utilize textures to reduce aerodynamic drag in all or some of the positions an athlete will engage in during an athletic activity. The movement of the arm and leg of an athlete running generally ranges from a position in front of athlete 705 to a position behind athlete 705. As illustrated, elbow range 710 that is covered during the run is significantly shorter than forearm range 720 during the performance of the same activity. As such, the forearm of athlete 705 may accelerate and decelerate at a greater intensity than the elbow of athlete 705. Similarly, thigh range 730 that is covered during the run is significantly shorter than knee range 740 and lower leg range 750. As such, the thigh of athlete 705 may experience a lesser magnitude of acceleration and/or deceleration than the knee of athlete 705 and the lower leg of athlete 705. Accordingly, the difference in magnitude between the acceleration and/or deceleration of the thigh affects the shape of an air profile of an athlete.

Further, in addition to the varied magnitudes of acceleration and/or deceleration at different point on the body of athlete 705, ranges 700 illustrate the differences in orientation of athlete 705 during running. For instance, across knee range 740, the knee of athlete 705 is flexing from approximately 90 degrees to approximately 180 degrees (not drawn to scale). This flex of the knee of athlete 705 affects the length and orientation of muscles in the thigh and lower leg of athlete 705, which in turn influences air flow around these areas. As such, air profiles of air flowing around body portions of athlete 705 is not only affected by the difference in speed, acceleration, and/or deceleration of body portions, but is also affected by the different orientation of body portions of athlete 705 during the performance of an activity (ies).

Figure 8A:
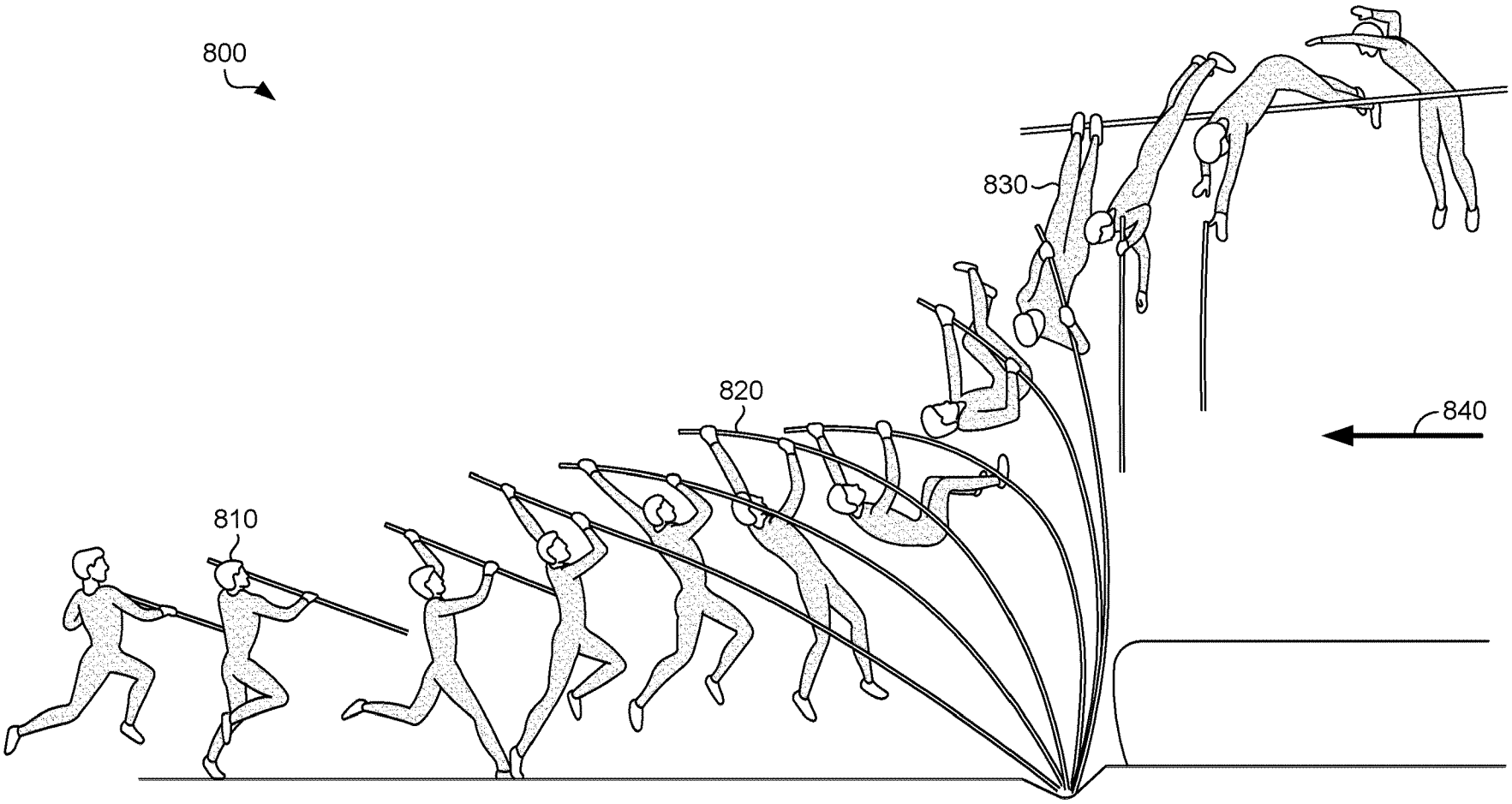
FIGS. 8A-8D illustrate a further example of the ranges of positions an athlete may take relative to ambient air during an athletic activity in accordance with the present invention.

FIGS. 8A-8D illustrate a plurality of positions of an athlete 800 associated with an athletic activity in accordance with embodiments of the present invention. In particular, FIGS. 8A-8D illustrate a plurality of positions of an athlete 800 pole-vaulting. As seen in FIG. 8A, air that is moving towards an athlete performing an activity will impact different areas of the athletic garment worn by the athlete indifferent ways based on the body position and movement of the athlete throughout the performance of the activity. Direction of air flow is indicated by air profile indicators 840. In particular, body positions 810, 820, and 830 are impacted by distinct air profiles against different portions of the aerodynamic garment. Although the body position profiles associated with the athletic activity of pole vaulting are provided in FIGS. 8A-8D, the use of air profiles associated with a plurality of body positions associated with any athletic activity as the basis of the designation of zones is covered by embodiments of the present invention.

Figure 8B:
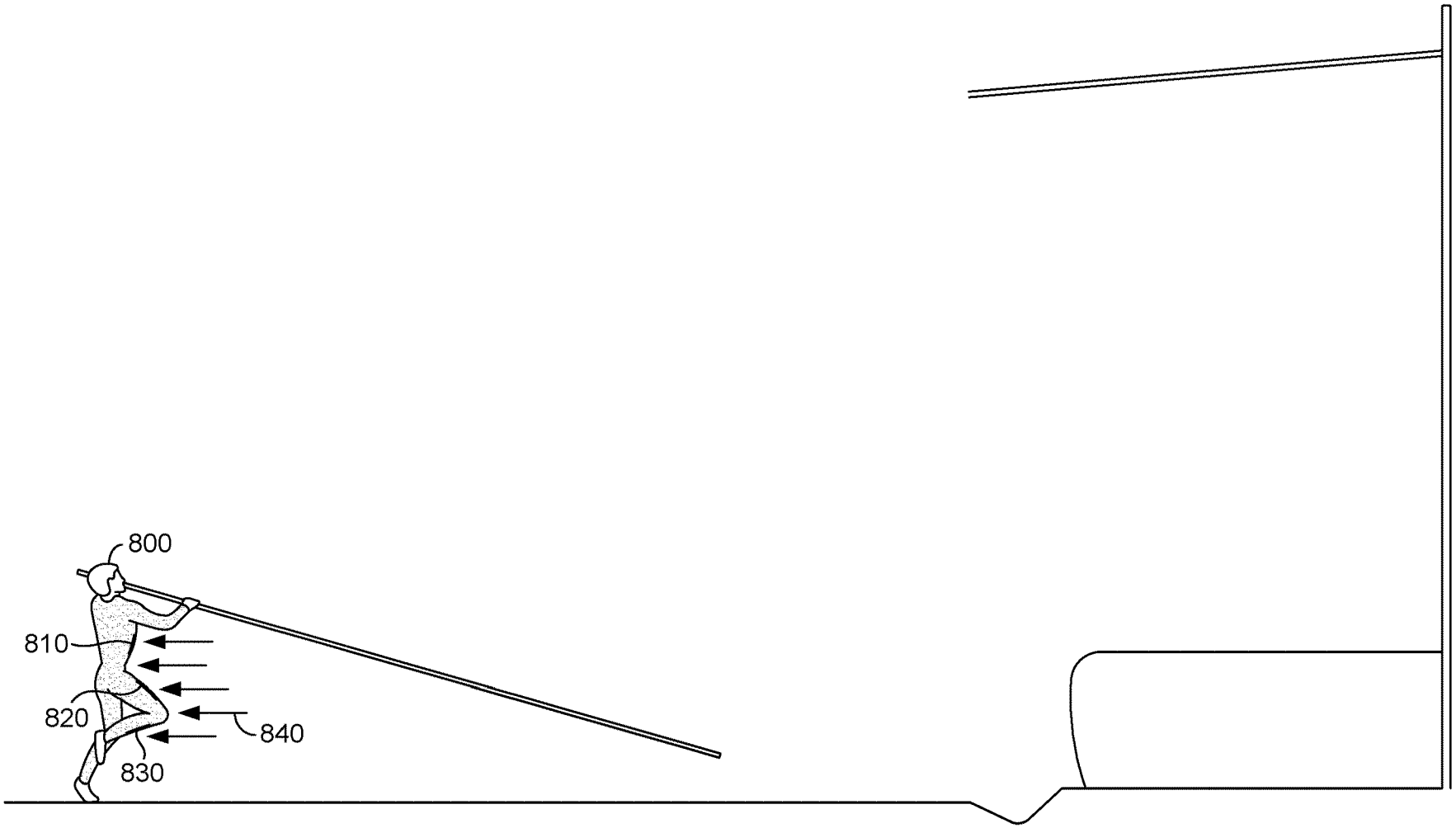

FIGS. 8A-8D illustrate an athlete 800 in various positions associated with an athletic activity while wearing a garment in accordance with the present invention. In the example illustrated in FIGS. 8A-8D, athlete 800 is pole vaulting, although other athletic activities may benefit from garments in accordance with the present invention. As the athlete 800 is running, air flow 840 impacts areas of the athlete's garment at different angles. The direction of air flow is illustrated by air profile indicators 840. In particular, zones 810, 820, and 830 are each impacted in different ways by air profile indicators 840 as the position of athlete 800 relative to the airflow changes. The texture used on different portions of the garment worn by athlete 800, such as zones 810, 820, and 830, may vary to minimize aerodynamic drag at different positions. For example, as shown in FIG. 8B, zone 810, located on the torso of the athlete does not move in as great of a swing during the run. As zone 820, located on the top of the athlete's thigh. Similarly, zone 830 is located on the lower leg of the athlete 800 and experiences yet greater swing. As such, zone 830 is the most distal of the zones discussed, and will accelerate and/or decelerate with greater magnitude than the top of the athlete's thigh when the athlete 800 is running.

Figure 8C:
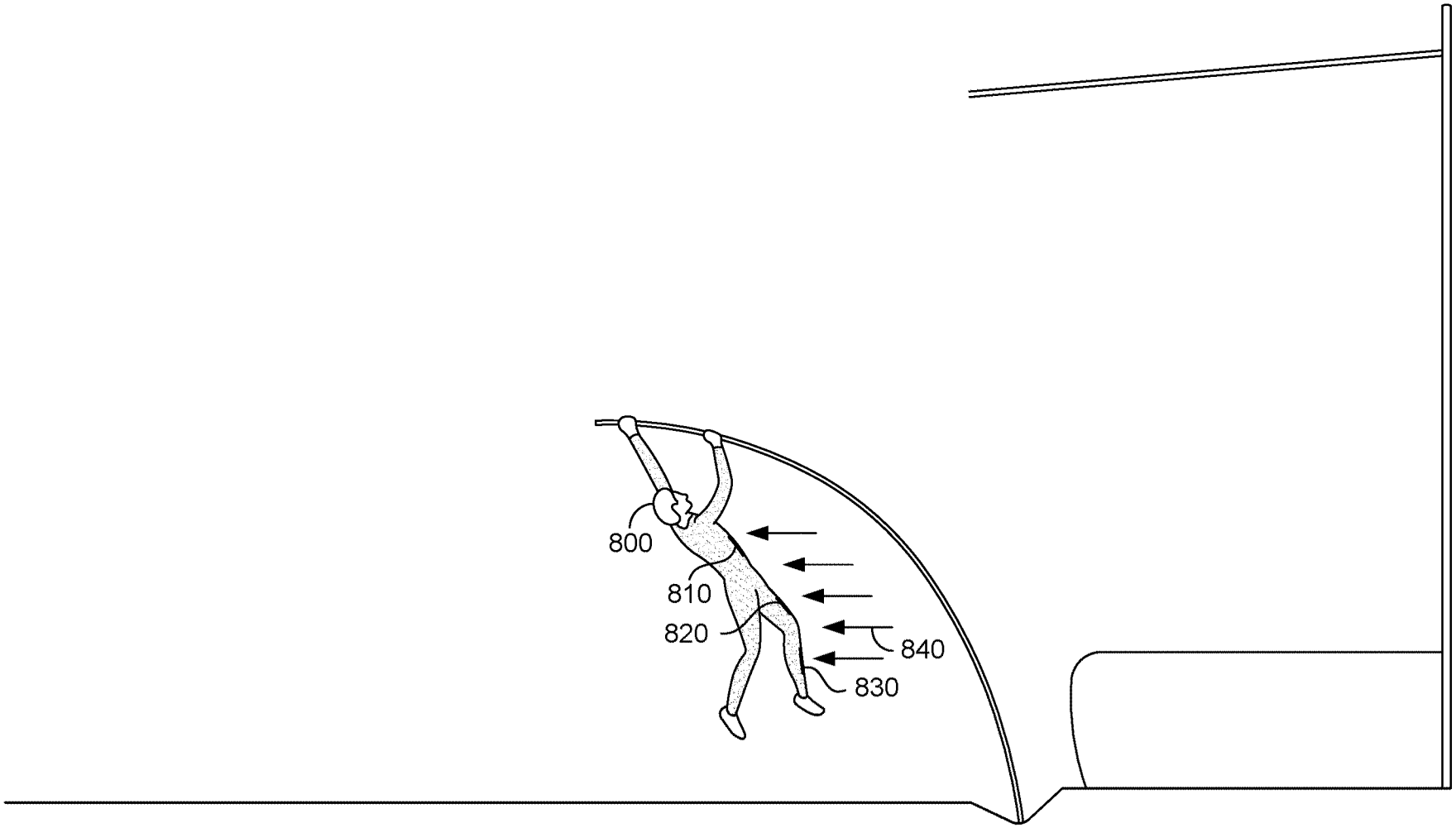

FIG. 8C illustrates a second position of an athlete 800 engaged in an athletic activity while wearing a garment in accordance with the present invention. As shown in FIG. 8C, athlete 800 begins to leap towards a pole vaulting bar. As the athlete 800 is leaping, air flow impacts areas of the athlete's garment at different angles. The direction of air flow is illustrated by air profile indicators 840. In particular, zones 810, 820, and 830 are each impacted in different ways by air profile indicators 840.

Figure 8D:
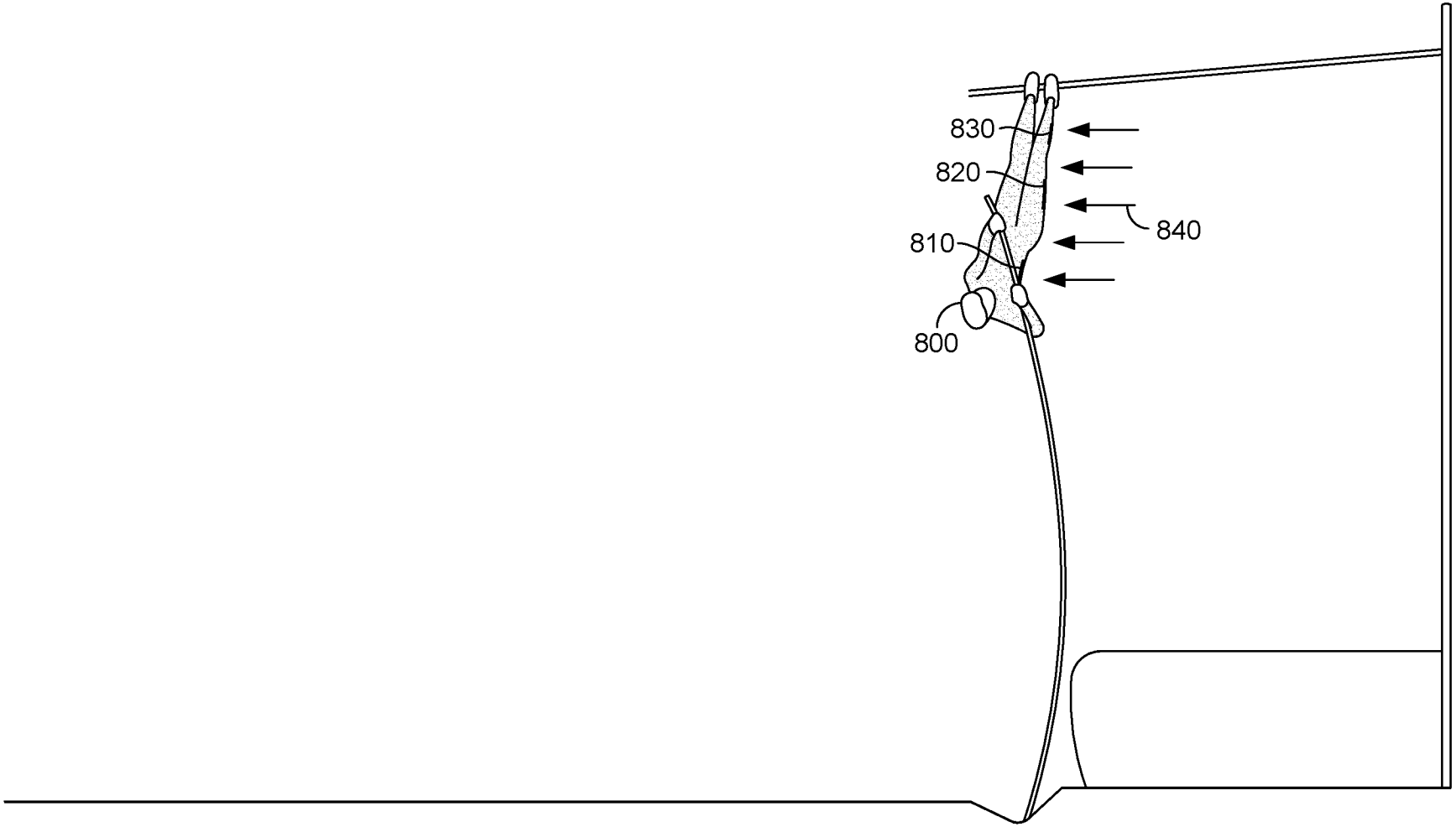

FIG. 8D illustrates a third position of an athlete 800 engaging in an athletic activity while wearing a garment in accordance with the present invention. The athlete 800 of FIG. 8D is ascending towards the pole vaulting bar in order to gain height to clear the bar. As the athlete 800 approaches the bar, air flow impacts areas of the athlete's garment at yet different angles. The direction of air flow is illustrated by air profile indicators 840. In particular, zones 810, 820, and 830 are each impacted in different ways by air profile indicators 840.

One or more of zones 810, 820, and 830 may be textured so as to minimize aerodynamic drag during one or more stage of athletic competition, such as one of the exemplary positions illustrated in FIGS. 8A-8D. Alternatively, one or more of zones 810, 820, and 830 may be textured to reduce aerodynamic drag in multiple stages of athletic competition. Also, one or more zones may be optimized for one or more stage of an athletic competition, while another zone or zones may be optimized for a different stage of an athletic competition. Of course, pole vaulting is only one example of an athletic competition; athletes engaging in any type of athletic competition may benefit from garments in accordance with the present invention. Further, garments in accordance with the present invention may use zones different from and/or in addition to zones 810, 820, and 830 illustrated in FIGS. 8A-8D.

The selection of an appropriate texture to apply to an area of the athletic garment may be based on properties, such as a Reynolds number, associated with the area of the athletic garment associated with a characteristic of an air profile. As such, each area influenced by a particular air profile may be associated with a unique applied texture to optimize drag associated with the athletic garment. Aerodynamic analysis methods, such as wind tunnel analysis, may be used to measure a Reynolds number or other desired aerodynamic properly of a texture under the aerodynamic conditions likely to be experienced during an athletic activity.

Figure 9:
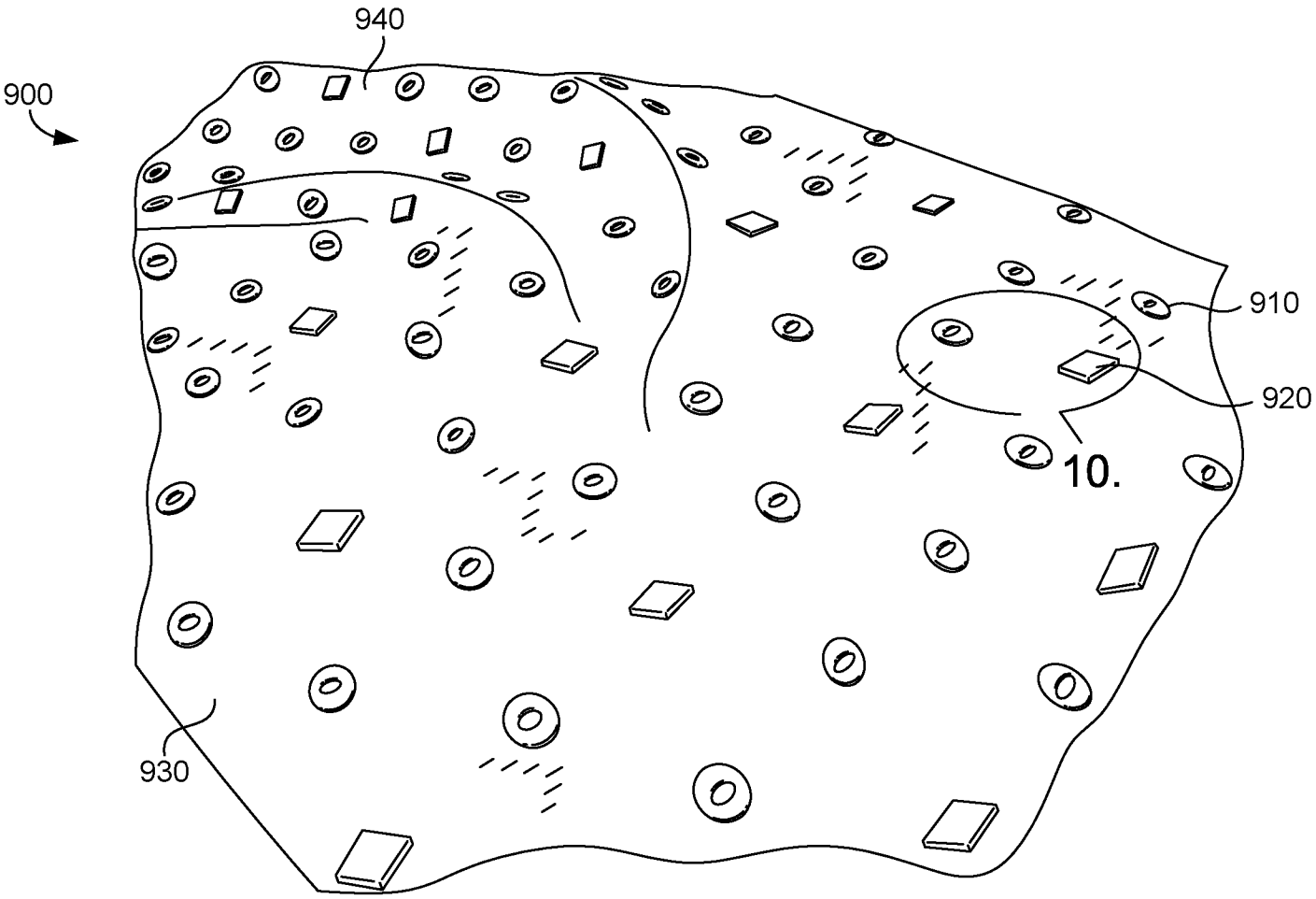
FIG. 9 illustrates an example of a textured portion of a garment in accordance with the present invention.

FIG. 9 illustrates a textured portion 900 of a garment in accordance with the present invention. For example, textured portion 900 may be part of a zone with an applied texture. The applied texture of portion 900 may possess a tripping property that gives rise to an aerodynamic characteristic of reducing drag on a garment. The boundaries of the zone may be defined based on exposure of the zone to an air profile of an athletic activity as described in figures above. The applied texture of FIG. 9 comprises of doughnut shaped nodules 910 and diamond shaped nodules 920 applied to a garment. As discussed above, nodules may be formed in any number of shapes, such as circles, hexagons, triangles, squares, etc. Nodules, such as nodules 910 and 920, may be formed by printing a material, such as silicon, onto a garment or fabric to be formed into a garment. In accordance with aspects herein, the term "doughnut shape" refers to any round shape having an aperture therethrough, while the term "disc shape" refers to any round shape.

If flocking is desired, the nodules may be formed by a liquid adhesive and/or a liquid appliqué with fibers applied to the liquid. The fibers of fabric may be uniformly oriented, but may also have other orientations. For example, nylon fibers may be electrostatically aligned into a uniform direction. Alternatively, fibers may have a random alignment. Fibers other than nylon may also be used, and more than one type of fiber may be used at the same time. The length of fibers used may be uniform or varied, and may be equal to the length and/or width of the nodules used, longer than the length and/or width of the nodules used, or shorter than the length and/or width of the nodules used. Fibers of varying lengths may be used at the same time.

The applied texture may have a tripping property that gives rise to an aerodynamic characteristic of reducing drag on a garment by prompting eddy formation based on tripping air flow around an extremity of a wearer of the garment. Further, a texture such as that illustrated in textured portion 900 may be applied to seams to allow for the minimization of drag at the seams. For example, a texture such as that illustrated in textured portion 900 may be placed on top of seams and/or areas surrounding seams. Additionally, textured portion 900 may be applied to items other than athletic clothing to control the drag on those items. For instance, drag resulting from air flow around sporting equipment and other structures may be reduced through the use of applied textures.

FIG. 9 also illustrates a range of density between area 930 and area 940, such that fewer nodules are in area 930 than in area 940. Further, FIG. 9 illustrates a range of mix ratios between doughnut shaped nodules and diamond shaped nodules. By altering the density of nodules, shape(s) of nodules, size of nodules, flocking of nodules, and/or mix ratio of an applied texture, the drag across the garment may be modified, as discussed above. For example, the arrangement of the plurality of nodules may be based on an air profile typically encountered during an athletic endeavor. For example, the plurality of nodules may be arranged over a garment in a density range that is proportional to an air profile experienced during sprinting, which may result in greater texture being applied at an athlete's extremities and lesser texture being applied at an athlete's torso.

Figure 10:
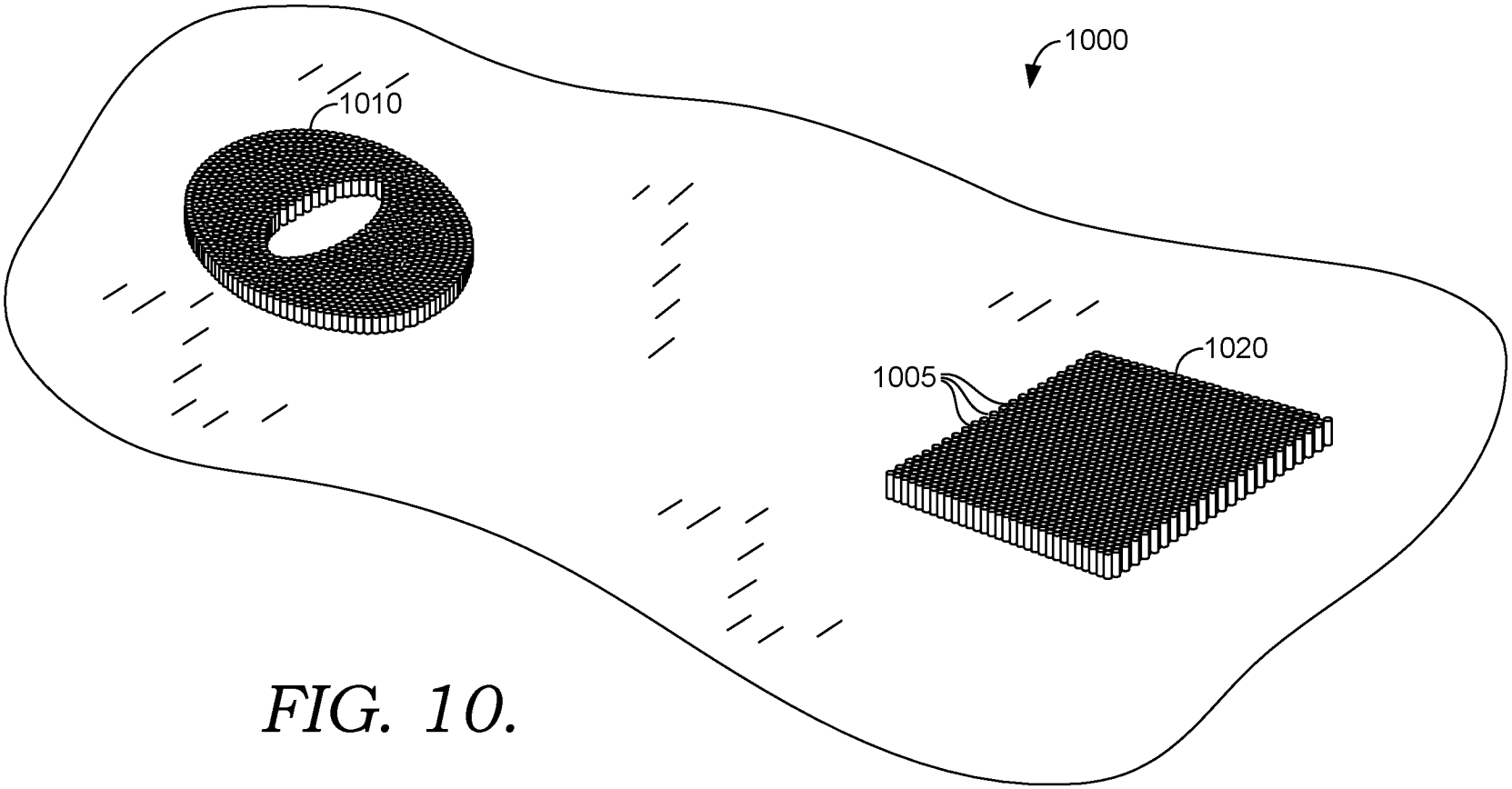
FIG. 10 illustrates an example of a flocked portion of a garment in accordance with the present invention.

FIG. 10 illustrates an enlarged flocked portion 1000 of a garment in accordance with the present invention. Flocked portion 1000 has an applied texture that consists of flocked nodules, particularly a doughnut-shaped flocked nodule 1010 and a diamond-shaped flocked nodule 1020. As seen in FIG. 10, nodules 1010 and 1020 are made of fibers 1005 that are arranged in a uniform fashion over an underlying adhesive material, such as silicon. In the example illustrated in FIG. 10, the fibers are oriented so as to extend more or less perpendicular to the surface of the garment. All other fiber orientations, such as parallel to the surface of the garment, an angular orientation with the surface of the garment, a mix of fiber orientations, or a random fiber orientation, are within the scope of the present invention.

The surface roughness may be applied to the desired portions of the garment using conventional processes and materials such as silk screening, printing, heat sealing, over-molding, or the like. Examples of processes for applying a transfer object to a fabric substrate are disclosed in U.S. Pat. Nos. 5,544,581 and 5,939,004, the disclosures of which are hereby incorporated by reference. These processes have been used to transfer a two-dimensional graphical image onto fabric. The transfer in the present invention has a desired three-dimensional shape (thickness), pattern, and density so as to form a desired aerodynamic array pattern, similar to riblets on an airplane wing, on the outer surface of the garment.

Figure 11B:
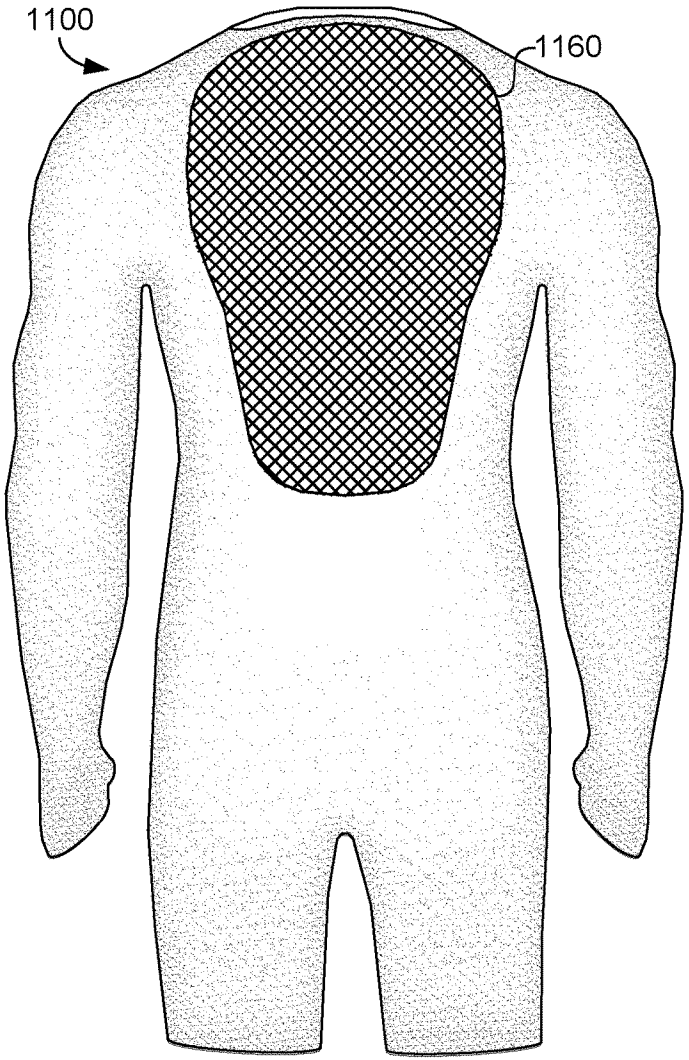
FIGS. 11A and 11B illustrate an example of a unitary body suit in accordance with the present invention.
Figure 11A:
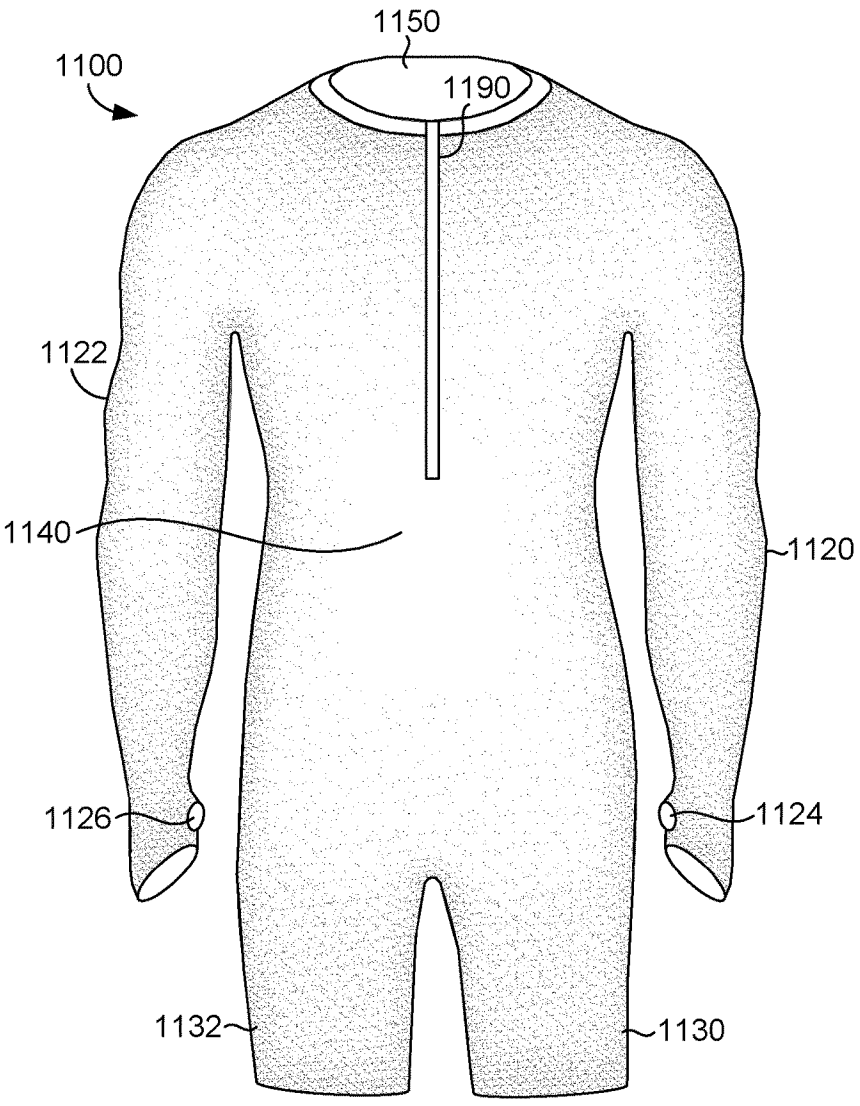

Referring now to FIGS. 11A and 11B, an example of a unitary garment 1100 for wear during athletic activities such as sprinting is illustrated. Unitary garment 1100 may comprise a first arm 1120, a second arm 1122, a first leg 1130, and a second leg 1132. Garment 1100 may further comprise a torso 1140. One or more textures may be applied to different regions of garment 1100 as described herein. The roughness of the applied texture may be greater at the extremities of garment 1100, such as near the wrists of first arm 1120 and second arm 1122. The texture may similarly be rougher at the periphery of an athlete's body as presented towards airflow while sprinting, such as on the sides of torso 1140. Meanwhile, surface roughness may be less in regions that will generate less aerodynamic drag during sprinting, such as the central region of torso 1140. Garment 1100 may be constructed of a highly elastic fabric to ensure a snug fit to the body of an athlete (not illustrated). Garment 1100 may additionally and/or alternatively be constructed of fabric with desirable moisture management, cooling or other properties. To facilitate a close fit, first arm 1120 may terminate in a portion including a thumbhole 1124, and second arm 1122 may terminate in a portion including thumbhole 1126. Further, first leg 1130 and second leg 1132 may terminate in foot portions, stirrups, or other devices (not shown) to secure the extremity of garment 1100 around the foot and/or ankle of an athlete wearing the garment 1100. Optionally, a zipper 1190 or any other closure mechanism may be used to facilitate the donning of garment 1100. Any closure mechanism used may have a texture associated with it to reduce aerodynamic dray produced by the closure mechanism. Additionally and/or alternatively, garment 1100 may be sufficiently stretchable to permit an athlete to don garment using neck hole 1150. While donning a garment using neck hole 1150 provides improved aerodynamic properties, as it eliminates a zipper 1190 or other closure mechanism that may produce additional aerodynamic drag, donning a garment through neck hole 1150 may also be sufficiently difficult for an athlete that a zipper 1190 or any other closure mechanism may be provided to close a garment after temporarily opening a portion of the garment 1100 for donning. A zipper 1190 or other fastener may be located anywhere upon garment 1100, and may be located to minimize the aerodynamic drag created by the fastener in the particular athletic activity for which the garment 1100 is intended to be worn for.

Referring now to FIG. 11B, a rearview of unitary garment 1100 is illustrated. As shown in FIG. 11B, a ventilation portion, in this example a back mesh portion 1160 in back of garment 1100 may provide ventilation and cooling of an athlete (not illustrated) wearing garment 1100. Back mesh portion 1160 may be constructed of any type of mesh and may be of varying size relative to back of garment 1100. Other mesh portions (not illustrated) may be used at locations other than the back of a garment in accordance with the present invention. Further, mesh portion 1160 and/or other ventilation portions (such as the additional example described below) may be omitted entirely from a garment in accordance with the present invention.

Figure 12:
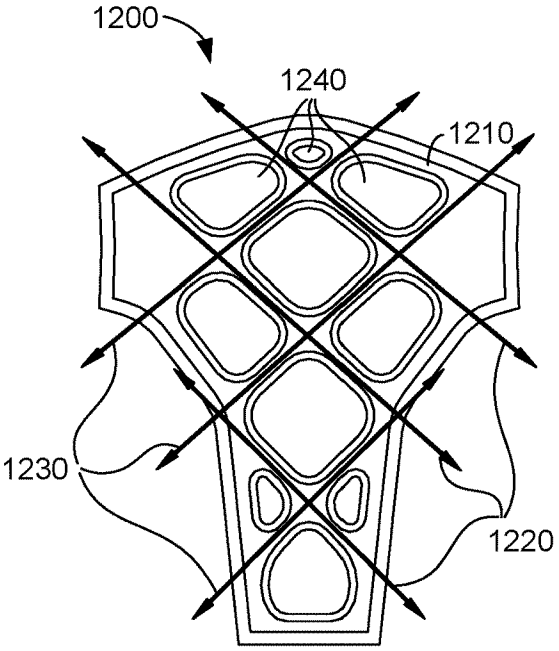
FIG. 12 illustrates an open back portion that may be used in conjunction with a garment in accordance with the present invention.

Referring now to FIG. 12, another example of a ventilation portion, in this example a cutout ventilation portion 1200, is illustrated. As illustrated in FIG. 12, cutout ventilation portion 1200 comprises a single piece of fabric 1210 with cutouts 1240 in the fabric 1210. The edges of each cutout 1240 may be treated with silicon or other material to prevent fraying, if desired. An edge treatment, if used, may be printed, heat transferred, glued, or otherwise applied to one or more edges of cutouts 1240. Cutouts 1240 may be located on fabric 1210 such that an entire thread of fabric 1210 may extend across the fabric 1210 without being severed at a cutout 1240. For example, individual threads may extend along lines 1220 and along lines 1230 to provide structural integrity to fabric 1210. Cutout ventilation portion 1200 is merely one example of a ventilation portion that may be used in conjunction with garments in accordance with the present invention. As discussed previously with regard to FIG. 11B, a mesh portion may also be used as a ventilation portion. A ventilation portion in accordance with the present invention may also comprise, for example, multiple pieces of fabric or strapping assembled to provide one or more openings for ventilation. Further, garments in accordance with the present invention may entirely omit a ventilation portion. Further, ventilation portions may be located at varying locations of a garment in accordance with the present invention, in addition to the back portion of a garment.

A cutout ventilation portion, one example of which is illustrated and described in conjunction with FIG. 12, also may be used in conjunction with garments other than the aerodynamic garments described herein. For example, other garments may benefit from a cutout ventilation portion that exposes the skin of the wearer to ambient air while also maintaining the strength and elasticity of the fabric without the additional weight and/or bulk of a ventilation portion constructed with multiple pieces. A cutout ventilation portion may comprise a piece of fabric having a plurality of threads and cutouts positioned such that at least a subset of the plurality of threads are not cut. The cutouts may be formed using die cutting, laser cutting, or other cutting techniques. The cutout edges may receive an edge treatment, such as described herein, may be applied to the cutout edges to prevent fraying. The cutout ventilation portion may be affixed to fabric covering a substantial portion of the torso and/or extremities of the wearer to form a garment. The fabric may have sufficient elasticity to provide a snug fit for the wearer. In this fashion, a cutout ventilation portion may provide cooling to the user while remaining light weight.

Figure 13B:
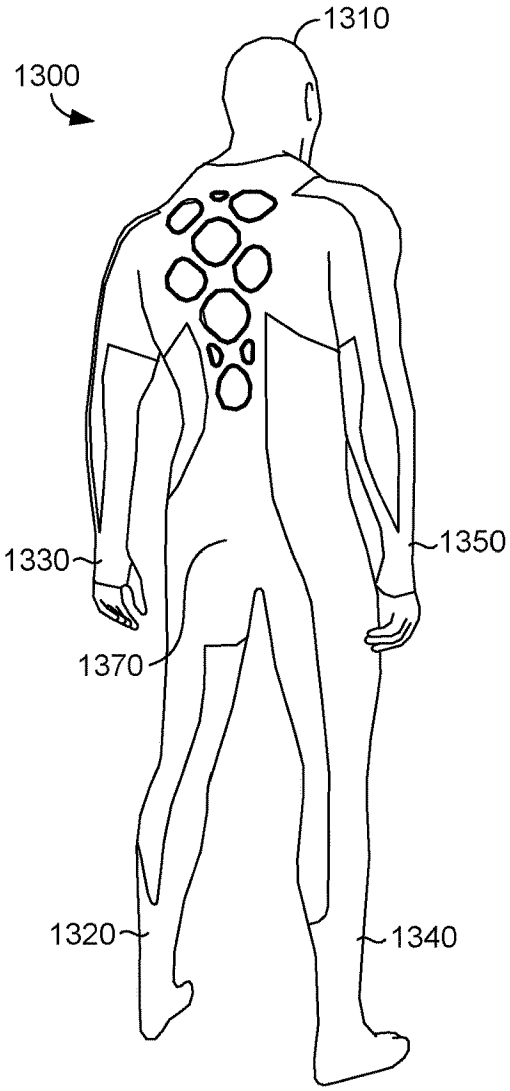
FIGS. 13A-13D illustrate views of a further garment in accordance with the present invention.
Figure 13A:
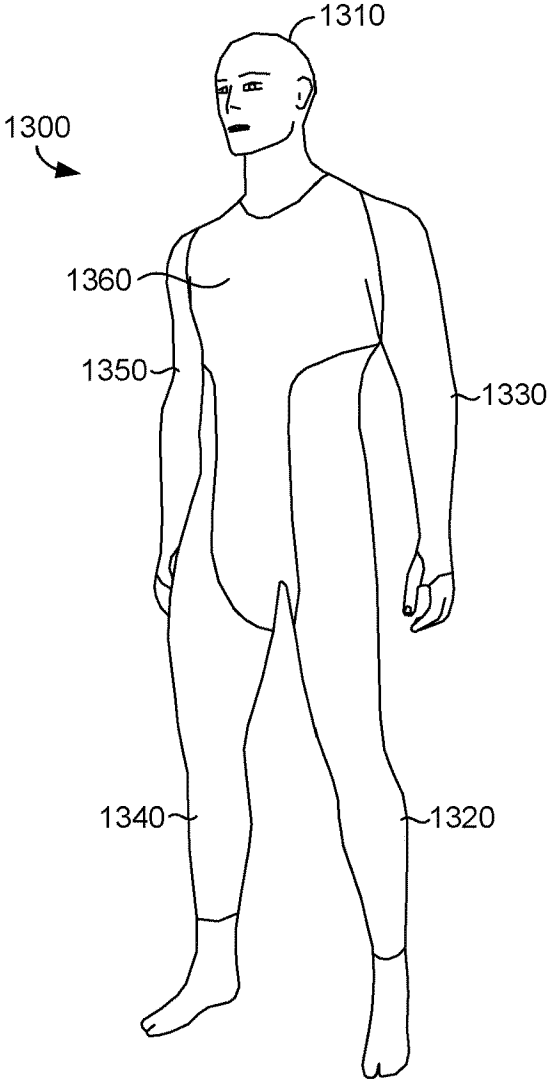

Referring now to FIG. 13A, a garment 1300 in accordance with the present invention is illustrated as worn by an athlete 1310. Garment 1300 may comprise a front torso region 1360 with little or no applied texture. Front torso region 1360 may be, for example, a relatively smooth fabric. Garment 1300 may further comprise a left side texture region 1320. Left side texture region may extend from at or near the ankle of athlete 1300 up the leg of athlete and at least partially up the torso of athlete 1310. Similarly, right leg texture region 1340 may extend from at or near the right ankle of athlete 1310 and up at least a portion of the side of the torso of athlete 1310. Left arm portion 1330 may be textured and may extend from at or near the left wrist of athlete 1310 past the elbow and even over the shoulder of athlete 1310. Similarly, right arm texture portion 1350 may extend from at or near the right elbow of athlete 1310, over the elbow and even past the shoulder of athlete 1310.

Referring now to FIG. 13B, a rear view of garment 1300 worn by athlete 1310 is illustrated. As further illustrated in FIG. 13B, a rear central zone 1370 may cover portions of the back torso of athlete 1310 and may further extend up the neck of athlete 1310, down back portions of the arms of athlete 1310, and may even extend down portions of the backs of the legs of athlete 1310. Zone 1370 may be constructed of a relatively smooth fabric similar to or different from that of front torso region 1360. A ventilation portion, such as that illustrated in FIG. 12, may be included in the back of garment 1300 as illustrated in FIG. 13B.

Figure 13C:
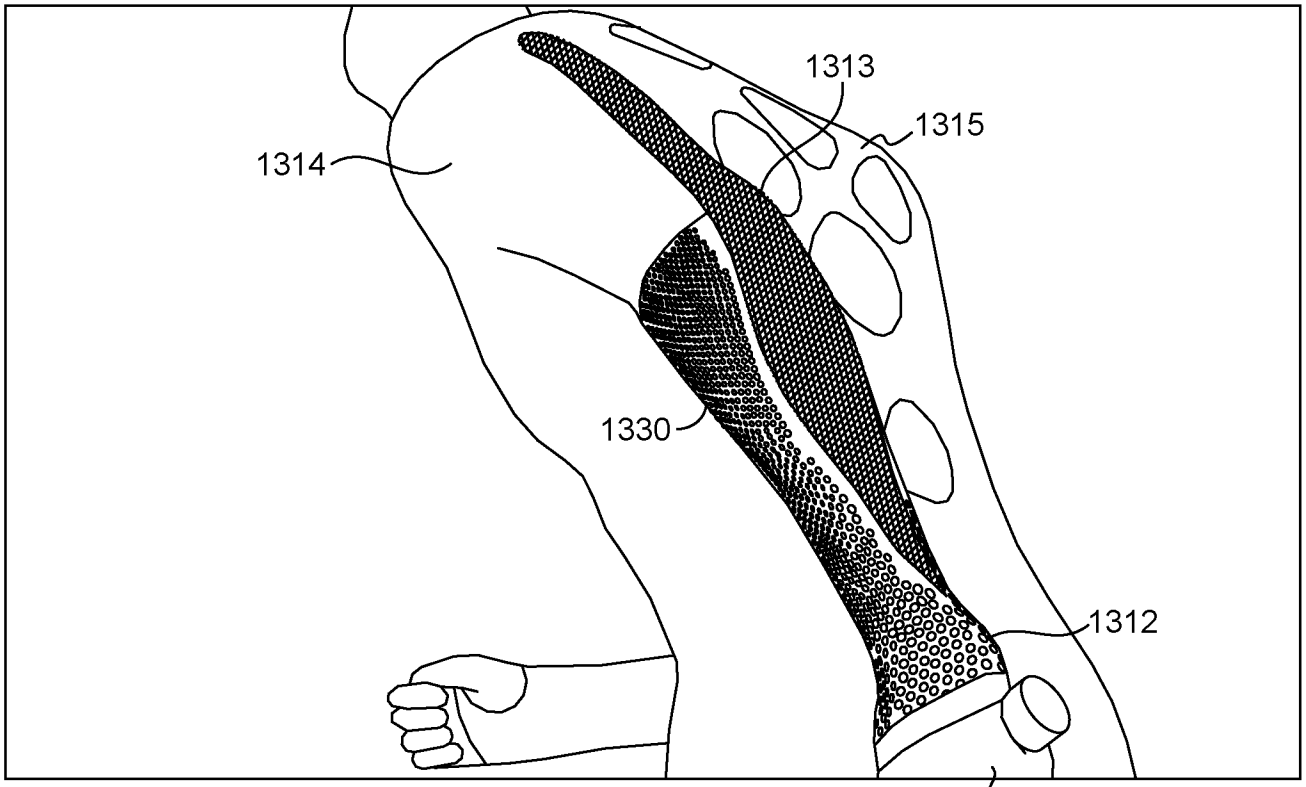

Referring now to FIG. 13C, a view of the left arm of athlete 1310 wearing garment 1300 is illustrated. As illustrated in FIG. 13C, left arm texture zone 1330 may comprise varying applied textures that change from hand 1311 of athlete 1310 to shoulder 1314 of athlete 1310. Garment 1300 may fit snuggly over wrist 1312, elbow 1313, and shoulder 1314 of athlete 1310. A back panel 1315 that may comprise a portion of rear central zone 1370 may optionally be constructed of a mesh material to provide ventilation for athlete.

Figure 13D:
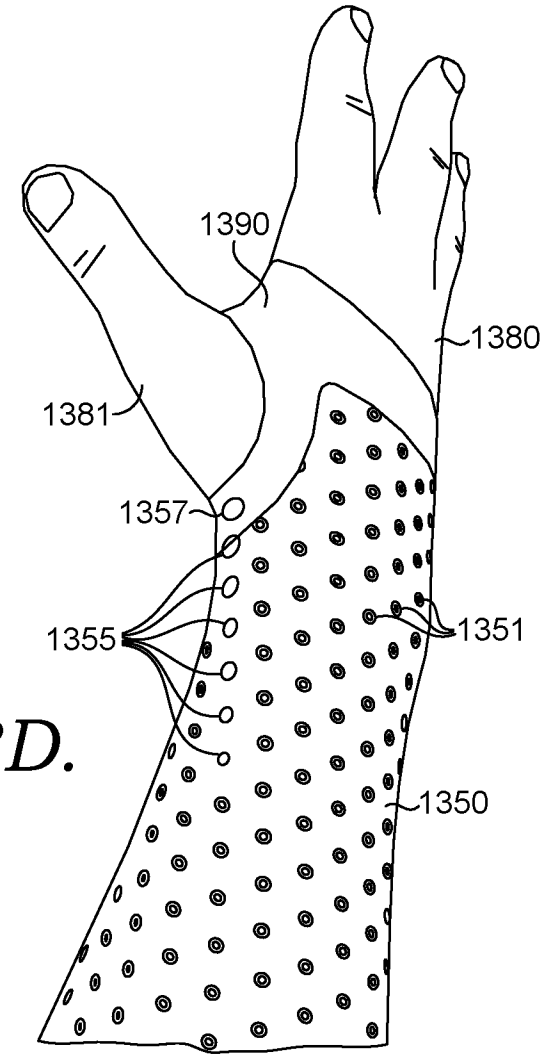

Referring now to FIG. 13D, further aspects of an exemplary garment 1300 are illustrated. FIG. 13D illustrates a portion of garment 1300 at and near the right hand of athlete 1310. As shown in FIG. 13D, a plurality of doughnut shaped nodules 1351 may be printed and optionally flocked on garment as previously described herein. Garment 1300 may include a thumbhole to permit garment 1300 to be secured over the hand 1380 and thumb 1381 of athlete 1310. Further, the hem 1390 of garment 1300 may be cut and printed with silicon similar to that used in printing nodules 1351. Hem 1390 may then be flocked to improve aerodynamic performance, as previously described herein. FIG. 13D further illustrates alignment dot 1357 on hem 1390 that may optionally be included to permit athlete to easily align garment on the body with thumb 1381. Further alignment dots 1355 may be included in the printed texture of garment 1300 to provide a visual indication of alignment of the garment 1300 on athlete 1310. Similar alignment markers may be provided on both arms of a garment 1300 and the legs of garment 1300 to assist an athlete in properly aligning the garment 1300 for optimal aerodynamic performance and comfort.

Figure 14A:
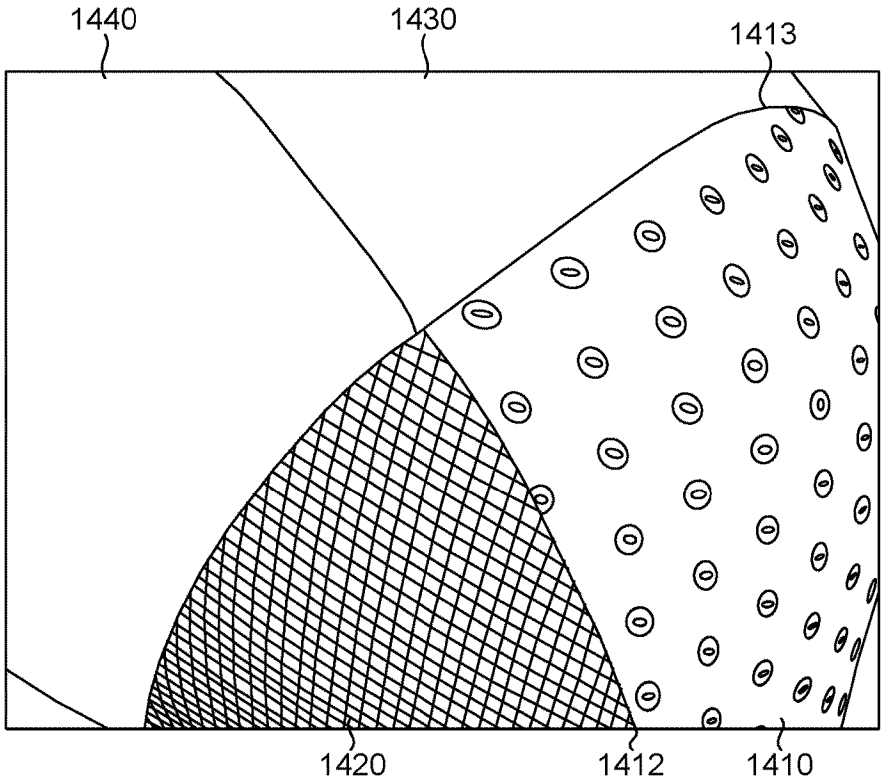
FIGS. 14A-14C illustrate further examples of textures and/or fabrics that may be used with a garment in accordance with the present invention.

Referring now to FIG. 14A, various textures and fabrics that may be used and even joined by seams in a garment in accordance with the present invention are illustrated. Zone 1410 comprises a plurality of flocked doughnut shaped nodules, that may be formed as described herein. Zone 1420 comprises a plurality of printed disc shaped nodules that may be unflocked, as described herein. Zone 1430 may be a first substantially smooth fabric used, for example, in a rear-facing portion of a garment. Zone 1440 may be a further smooth fabric portion, that may utilize the same or a different fabric than zone 1430. Zone 1440 may, for example, comprise a central torso portion in a garment such as 1300 illustrated in FIGS. 13A-13D.

Figure 14C:
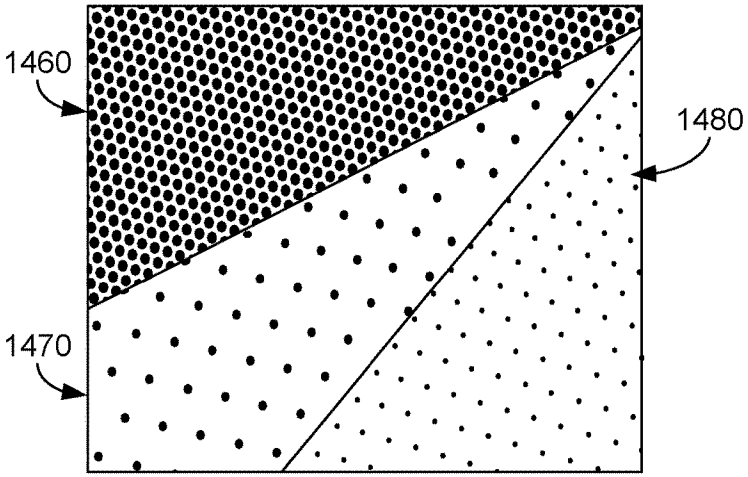
Figure 14B:
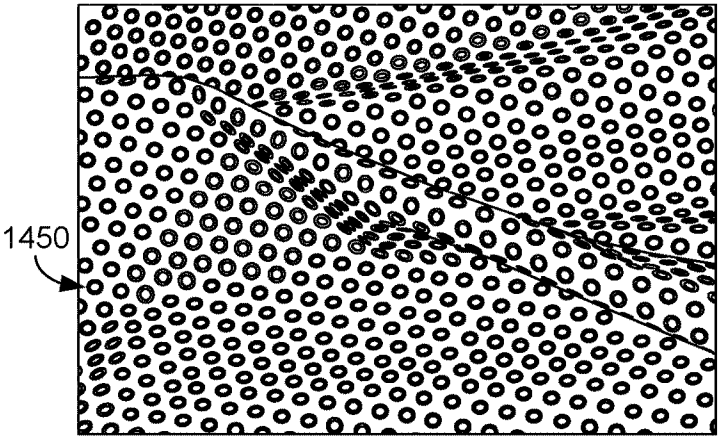

Referring now to FIG. 14B and FIG. 14C, additional textures that may be printed on a fabric in accordance with the present invention are illustrated. FIG. 14B illustrates a zone 1450 having a plurality of flocked doughnut nodules. FIG. 14C illustrates three additional densities and sizes of nodules that may be printed to provide a texture on a garment in accordance with the present invention. Zone 1460 illustrates a densely printed plurality of relatively large dots. Zone 1470 illustrates a relatively sparse texture with medium-sized dots. Zone 1480, meanwhile, illustrates a moderately sparse pattern of relatively small dots. As shown in FIGS. 14B and 14C, any number of patterns may be printed to provide a texture in accordance with the present invention. Further, shapes other than the symmetric circles and dots illustrated in FIGS. 14B and 14C may be used in accordance with the present invention.

Figure 15:
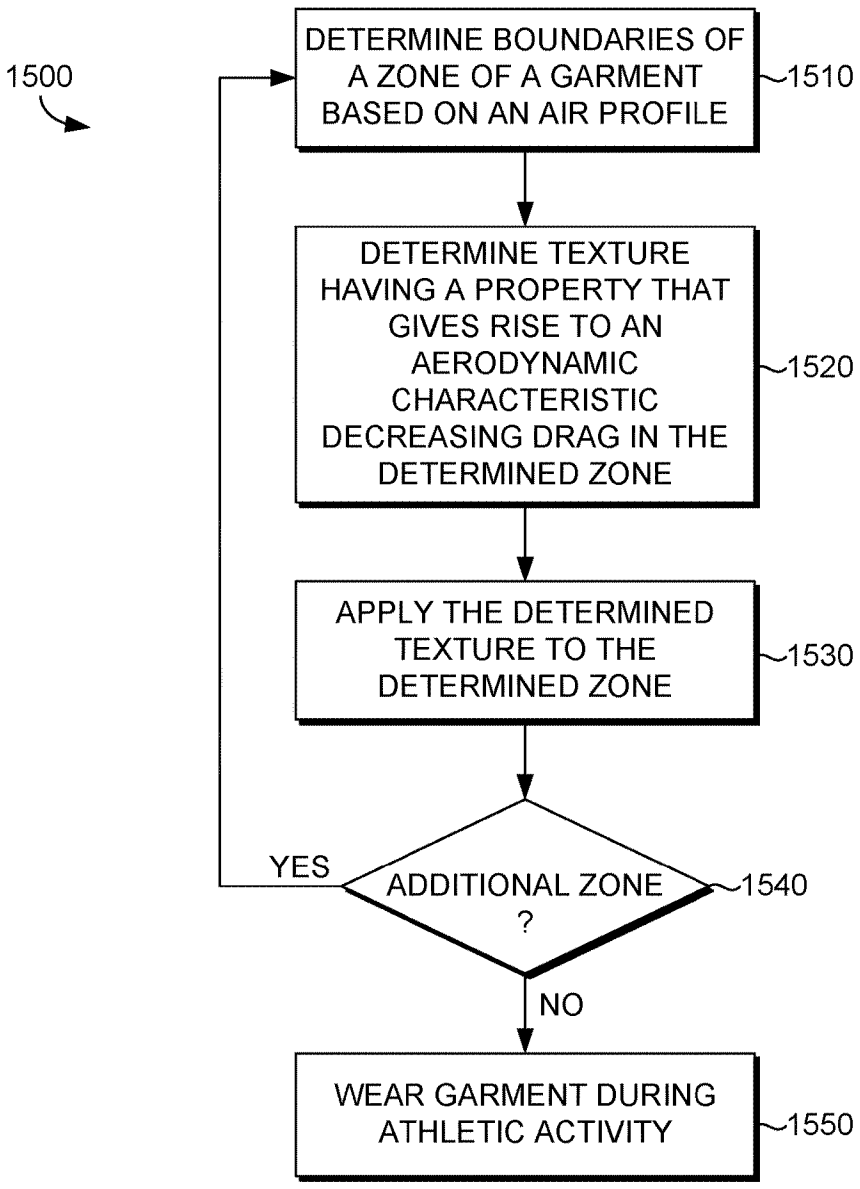
FIG. 15 illustrates a method for forming a garment in accordance with the present invention.

Referring now to FIG. 15, a method 1500 for forming a garment in accordance with the present invention is illustrated. In step 1510, the boundaries of a zone of a garment are determined based on an air profile. The air profile used in step 1510 may be the air profile experienced by a portion of the garment when worn by an athlete during an athletic activity. The air profile may depend upon the body position of the athlete and/or movement of the athlete relative to ambient air. The air profile experienced may vary based upon the athletic activity, or even the athlete, intended to wear the garment. In step 1520, a determination of a maybe made texture having a property that gives rise to an aerodynamic characteristic decreasing drag in the determined zone. Step 1520 may use the air profile considered in step 1510. The texture determined in step 1520 may be any of those described herein, such as a geometric shape, a flocked nodule, an unflocked nodule, or any other texture that may be applied to a garment. Step 1510 and/or step 1520 may utilize wind tunnels and/or other types of aerodynamic analysis. In step 1530, the determined texture from step 1520 may be applied to the determined zone from step 1520. Step 1530 may be performed using printing techniques, for example, to apply a texture to the surface of a garment or a fabric for incorporation into a garment. In step 1540, a determination may be made as to whether an additional zone on the garment is desired. If an additional zone is required or desired, method 1500 may return to step 1510 for the determination of another zone and step 1520 for the determination of another texture. It should be appreciated that step 1540 may occur prior to step 1530, such that multiple zones having multiple textures may be applied substantially simultaneously. If the conclusion of step 1540 is that no additional zones are needed or desired, method 1500 may proceed to step 1550, at which point the garment may be worn by an athlete during an athletic activity. One or more of steps 1510, 1520, 1530, and 1540 may be performed prior to fabrication of the garment worn in step 1550, step 1530 may, for example, be performed using a fabric portions that will subsequently formed into a garment.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. For example, the surface roughness 12 is described as patterns of protrusions extending from the surface of the fabric. However, heat searing or other methods may be used to form patterns of recesses and/or combinations of recesses and protrusions within the fabric without compromising the scope of the invention. The same may also be varied in many ways. Such variations are not to be regarded as a departure from the invention, and all such modifications are intended to be included within the scope of the invention.

What is claimed is:

1. A garment comprising:

a first zone located on an arm portion of the garment, the first zone having a first applied surface texture, the first applied surface texture comprising a first plurality of three-dimensional (3-D) nodules each extending outwardly from a surface of the garment;

a second zone located on a torso portion of the garment, the second zone having no applied surface texture, wherein:

the first applied surface texture begins at a shoulder region of the arm portion of the garment, and wherein the first applied surface texture smoothly and continuously transitions from a minimum amount of surface roughness at the shoulder region of the garment, to a maximum amount of surface roughness at a distal end of the arm portion of the garment; and a hem affixed to the distal end of the arm portion of the garment and extending to a distal edge of the arm portion of the garment, wherein the hem is printed with silicone, and wherein the distal edge forms a sleeve opening of the arm portion.

2. The garment of claim 1, wherein the first applied surface texture comprises a first property that gives rise to a first aerodynamic characteristic, the first aerodynamic characteristic adapted to trip air flow around an extremity of a wearer to prompt eddy formation when the garment is in an as-worn configuration.

3. The garment of claim 1, wherein the first plurality of 3-D nodules are applied to the garment in a first density range, and wherein the first density range comprises a first density of the first plurality of 3-D nodules located at the shoulder region of the garment, and a second density of the first plurality of 3-D nodules at the distal end of the arm portion of the garment, and wherein the second density is greater than the first density.

4. The garment of claim 1, wherein the first plurality of 3-D nodules are flocked.

5. The garment of claim 1, wherein a three-dimensional shape of the first plurality of 3-D nodules comprises a rectangular shape.

6. The garment of claim 1, wherein a three-dimensional shape of the first plurality of 3-D nodules comprises an elongated circular shape.

7. The garment of claim 1, wherein a three-dimensional shape of the first plurality of 3-D nodules comprises a doughnut shape.

8. The garment of claim 1, wherein a three-dimensional shape of the first plurality of 3-D nodules comprises a disc shape.

9. The garment of claim 1, wherein the first plurality of 3-D nodules comprises silicone printed on the garment.

10. The garment of claim 9, wherein the silicone is applied to the garment through a screen printing process.

11. The garment of claim 1, wherein the first zone and the second zone are located on a base fabric layer of the garment.

12. The garment of claim 11, wherein the base fabric layer of the garment comprises elastic yarns.

13. The garment of claim 1, wherein the first zone and the second zone are located on the garment based on exposure of each zone to air profiles associated with an athletic activity when the garment is in an as-worn configuration.

14. A garment comprising:

a first zone located on an arm portion of the garment, the first zone having an applied surface texture, the applied surface texture comprising a first plurality of three-dimensional (3-D) nodules each extending outwardly from a surface of the garment;

a second zone located on a torso portion of the garment;

a third zone having another applied surface texture and located between the first zone and the second zone, wherein:

the second zone has no added surface roughness, and the applied surface texture begins at a shoulder region of the first zone of the arm portion of the garment, and the applied surface texture smoothly and continuously transitioning from the another applied surface texture adjacent to the third zone to a maximum surface roughness at a distal end of the arm portion of the garment; and a hem affixed to the distal end of the arm portion of the garment and extending to a distal edge of the arm portion of the garment, the distal edge forming a sleeve opening of the arm portion of the garment, wherein the hem is flocked.

15. The garment of claim 14, wherein the applied surface texture gives rise to a first aerodynamic characteristic.

16. The garment of claim 15, wherein the first zone and the second zone are located on the garment based on exposure of each zone to air profiles associated with an athletic activity when the garment is in an as-worn configuration.

17. A garment comprising:

a torso portion, and a first arm portion and a second arm portion extending from the torso portion, each of the first arm portion and the second arm portion comprising a first applied surface texture comprising a first plurality of three-dimensional (3-D) nodules each extending outwardly from a surface of the garment;

wherein:

the first applied surface texture begins at a shoulder region of the first arm portion and the second arm portion of the garment, and wherein the first applied surface texture smoothly and continuously increases from the shoulder region of the first arm portion to a first distal end of the first arm portion, and wherein the first applied surface texture smoothly and continuously increases from the shoulder region of the second arm portion to a second distal end of the second arm portion, the torso portion comprises no applied surface texture; and a first hem affixed to the first distal end of the garment and extending to a first distal edge of the garment, and a second hem affixed to the second distal end and extending to a second distal edge of the second arm portion, wherein the first hem and the second hem are printed with silicone, and further wherein the first distal edge forms a first sleeve opening of the first arm portion and the second distal edge forms a second sleeve opening of the second arm portion.

18. The garment of claim 17, wherein the first applied surface texture gives rise to a first aerodynamic characteristic comprising greater air flow tripping around the first distal end of the first arm portion and the second distal end of the second arm portion of the garment as compared to air flow tripping around a first proximal end of the first arm portion and a second proximal end of the second arm portion of the garment when the garment is in an as-worn configuration.

* * * * *